US008863743B2

(12) United States Patent
Sitabkhan et al.

(10) Patent No.: US 8,863,743 B2
(45) Date of Patent: Oct. 21, 2014

(54) HERMETICALLY WELDED SEALED OXYGEN CYLINDER ASSEMBLY AND METHOD OF CHARGING

(75) Inventors: Abdul N. Sitabkhan, Arcadia, CA (US); Michael A. Mallari, Alta Loma, CA (US); Souvanh Bounpraseuth, Ontario, CA (US)

(73) Assignee: Ametek Ameron, LLC, Baldwin Park, CA (US)

( * ) Notice: Subject to any disclaimer, the term of this patent is extended or adjusted under 35 U.S.C. 154(b) by 332 days.

(21) Appl. No.: 13/383,816

(22) PCT Filed: Jul. 16, 2010

(86) PCT No.: PCT/US2010/042330

§ 371 (c)(1),
(2), (4) Date: Jan. 12, 2012

(87) PCT Pub. No.: WO2011/009079

PCT Pub. Date: Jan. 20, 2011

(65) Prior Publication Data

US 2012/0111871 A1 May 10, 2012

Related U.S. Application Data

(60) Provisional application No. 61/225,954, filed on Jul. 16, 2009.

(51) Int. Cl.

| | |
|---|---|
| ***A62B 7/00*** | (2006.01) |
| ***A62B 9/00*** | (2006.01) |
| ***A62B 7/14*** | (2006.01) |

(52) U.S. Cl.

CPC ..... *A62B 7/14* (2013.01)
USPC ..... 128/205.21

(58) Field of Classification Search

USPC ..... 128/204.18, 205.21, 205.22; 222/3, 5, 222/80, 81, 83; 137/68.29, 68.3, 68.13; 220/581–583, 601, 612, 400.7; 141/2, 141/18, 31

See application file for complete search history.

(56) References Cited

U.S. PATENT DOCUMENTS

| | | | | | |
|---|---|---|---|---|---|
| 2,329,289 | A | | 9/1940 | Morehouse | |
| 3,618,822 | A | * | 11/1971 | Hildenbrandt, Jr. | 222/3 |
| 3,633,596 | A | * | 1/1972 | Gerber | 137/68.3 |
| 3,636,992 | A | * | 1/1972 | Weidner | 141/4 |
| 3,762,604 | A | * | 10/1973 | Shonerd | 222/5 |
| 3,981,300 | A | | 9/1976 | Williams | |
| 4,143,545 | A | * | 3/1979 | Sitabkhan | 73/146.8 |
| 4,579,136 | A | * | 4/1986 | Oman et al. | 137/68.13 |
| 4,828,131 | A | * | 5/1989 | Strubel | 222/464.7 |
| 5,029,730 | A | * | 7/1991 | Kostecki et al. | 222/3 |

(Continued)

*Primary Examiner* — Justine Yu
*Assistant Examiner* — Kathrynn Reilly

(57) ABSTRACT

An emergency oxygen system for aircraft passengers includes a hermetically welded sealed oxygen cylinder of stainless steel, a welded metal diaphragm sealing a discharge port and an extended hermetically sealed capillary tube for charging the cylinder with pressurized oxygen. A hollow piston cutter is driven to pierce the metal diaphragm as part of a first passageway delivering oxygen to the passenger. A second passageway delivers any leaking oxygen to a release port when the piston cutter is in position. A method of filling the cylinder includes welding to the cylinder a member having a metal diaphragm of a predetermined rupturable characteristic and using the open capillary tube to fill oxygen in the cylinder and subsequently crimping a portion of the capillary tube to provide a hermetic seal. A pressure gauge can be hermetically sealed to the bottom of the oxygen cylinder.

16 Claims, 8 Drawing Sheets

(56) References Cited

U.S. PATENT DOCUMENTS 5,123,409 A * 6/1992 Sheffield et al. ..... 128/204.18
5,441,302 A * 8/1995 Johnson et al. ..... 280/736
5,566,853 A * 10/1996 Schenker et al. ..... 220/581
6,155,258 A * 12/2000 Voege ..... 128/205.21
6,708,692 B2 * 3/2004 Lee et al. ..... 128/205.24

* cited by examiner

HERMETICALLY WELDED SEALED OXYGEN CYLINDER ASSEMBLY AND METHOD OF CHARGING

CROSS-REFERENCE TO RELATED APPLICATION

The present application claims priority from the U.S. Provisional Application No. 61/225,954 filed on Jul. 16, 2009.

BACKGROUND OF THE INVENTION

1. Field of the Invention

The present invention is directed to a hermetically welded and sealed oxygen cylinder assembly and more particularly, to a stored oxygen system that can release pure oxygen to aircraft crew and passengers with an extended life period that does not require frequent verification of status when installed in an aircraft.

2. Description of Related Art

Modern aircraft that fly passengers above 15,000 feet are required to meet certain standards as defined, for example, in the NASA/CR-2001-210903 "Onboard Inner Gas Generation System/Onboard Oxygen Gas Generation System Study, Part 1, Aircraft System Requirements," May 2001.

Current passenger aircraft are required to be equipped with an emergency breathing system to provide oxygen should there be a failure of the primary pressurization system in the aircraft cabin. Thus, emergency breathing oxygen is made available to both crew and passengers, and is required to be operable for a sufficient period of time to enable a descent of the aircraft down to 10,000 feet. The passenger oxygen system is not designed to protect from smoke and toxic fumes, as required for the crew, but only against hypoxia.

The oxygen system for the crew members is separate from that of the passengers and further require sufficient oxygen to provide 15 minutes of breathing per crew member of oxygen at a cabin pressure altitude of 8,000 feet. Thus, for each crew member, 300 liters of the oxygen must be provided as a minimum and if the supply of oxygen falls below this minimum level, the pilot is required to reassess the flight plan and take appropriate action for the further operation of the aircraft, as required by the FAA and Joint Aviation Authorities (JAA).

Conventionally there have been two types of passenger oxygen systems that have been utilized in commercial jet transportation, namely chemical generation systems and stored gaseous systems. The chemical generation system has oxygen stored in the form of chemicals that are inside a metal container such as an oxygen chemical generator that can be stored above the passengers. When a chemical reaction is initiated upon an activation of a firing mechanism, such as pulling of the mask by a user, a pyrotechnic emission of the chemicals inside of the oxygen generator is created and 99.5% pure oxygen can be released.

Alternatively, for supplementing a chemical generation system, a gaseous oxygen system which utilizes pressurized cylinders such as 3,200 liter cylinders can be maintained at 1,850 PSI. An advantage of the gaseous oxygen system is the flexibility in adding additional cylinders to accommodate different flight profiles by extending an aircraft's capabilities by adjusting the number of oxygen cylinders. For example, a 777-300 aircraft would require 11 bottles of oxygen for just the passengers. The oxygen is stored in large pressure cylinders and is piped into various sections of the aircraft and, in an emergency, is actuated from the cockpit or automatically actuated by pressurization changes. The oxygen will flow from a valve on each of the pressurized cylinders to a regulator assembly where the pressure is reduced and subsequently flows into the individual mask for each passenger. The FAA/JAA requires the passenger oxygen system to be operative before the aircraft cabin's altitude exceeds 15,000 feet and be capable of releasing the required amount of oxygen in less than 10 seconds.

The current aircraft such as the Boeing 747, 767 and 777 and the Airbus A300, 320, 330 and 340 generally store their oxygen in large oxygen pressure cylinders, that are approximately 18 to 200 cubic inches in volume and are maintained at a normal pressure of approximately 1800 PSIG. These oxygen pressure cylinders have a Department of Transportation classification of DOT 3HT which require re-hydro tests and recharging every three years by the airline.

In addition, most of these emergency oxygen systems employ a valve sealing a main oxygen cylinder pressure with an elastomeric or metal crush seal washer that are not hermetically welded sealed. Generally the cylinder and the valve cannot be separated in prior art systems.

Thus, a substantial economic issue is involved in the removal and replacement in commercial aircraft of mounted oxygen pressure cylinders for re-hydro testing and recharging every three years. Additionally, a large number of spare cylinders are required to support this function by each of the individual aircraft operators at locations on a worldwide basis. This involves higher inventory cost along with the expensive man hours required to perform the retesting. Another major economic issue is the transportation of the cylinders removed from the aircraft to the retest and recharge facility.

It is further contemplated that proposed newer generation aircraft, such as the Boeing 787 and the Airbus A350, are planning to use smaller cylinders for oxygen storage and will be charged to a higher pressure to accommodate greater volume of oxygen in smaller cylinder volumes. Such newer cylinders are contemplated to be under a DOT classification of DOT 39. This specification permits oxygen cylinders to remain onboard the aircraft for long periods of time, provided they can safely maintain their oxygen charge. These pressurized cylinders cannot be recharged or reserviced.

The current common types of oxygen cylinders are composed of aluminum lined with carbon or Kevlar fibers on their outside. The internal wetted surfaces of the oxygen cylinders are coated with a type of polymer resin to protect against the effects of high pressure oxygen. An alternative commonly used oxygen cylinder is made from a 4130 carbon steel. Such cylinders have to be protected externally with an epoxy paint and also internally with a zinc phosphate plating. These types of internal coatings can be subject to cracking and chipping over an extended period of time, due to the constant pressure changes caused by temperature changes with corresponding expansions and contractions that can occur over the life of the aircraft. The resulting loose particulate material that may accumulate within the oxygen cylinder is a potential source of ignition during a cylinder content discharge as a result of the friction heat caused by high rate particle impacts. Since relatively pure oxygen is well known to be conducive to a fire in an appropriate environment, there is a need to provide an improved oxygen pressure cylinder that can take advantage of the extended life permitted under the DOT 39 classification.

SUMMARY OF THE INVENTION

An emergency oxygen system for aircraft crew and passengers includes a source of stored pressurized oxygen capable of being maintained for a significantly long period of time, with a delivery system for conveying the released oxygen to crew and passengers. A hermetically sealed oxygen cylinder of stainless steel with a welded metal diaphragm of stainless steel can seal a discharge port in the oxygen cylinder. A capillary tube can be connected to the oxygen cylinder for initially charging the cylinder with pressurized oxygen and then subsequently being hermetically sealed to secure a long-term storage of the pressurized oxygen within the oxygen cylinder.

The hermetically sealed oxygen cylinder can include a discharge outlet body assembly, including a cylinder neck member hermetically sealed to the oxygen cylinder, with a passageway extending through the cylinder neck member by brazing or welding to transport the oxygen. The capillary tube can be mounted on the cylinder neck member and an appropriate annular exterior groove can be utilized for wrapping the capillary tube into a stored position after it has been hermetically sealed. The capillary tube can be crimped and subsequently further hermetically sealed by brazing or welding downstream of the crimped portions before it is stored. The capillary tube is in fluid communication with an internal conduit through the cylinder neck member to deliver pressurized oxygen to the stainless steel oxygen cylinder for charging the cylinder.

The discharge outlet body assembly can include a piston cutter member that is positioned to be aligned with a metal diaphragm so that a driving member such as an explosive cartridge, solenoid or other mechanical force creating device can be applied to one end of the piston cutter member to drive a distal sharp end for rupturing the metal diaphragm to release the pressurized oxygen. The piston cutting member is hollow to provide a conduit for directing the released pressurized oxygen with appropriate seals for isolating the conduit of the piston cutter member. An opening in a side wall of the hollow portion of the piston cutter member can release oxygen apart from the delivery system to the passengers and crew. Thus, any inadvertent release of oxygen by the metal diaphragm would be directed to an exterior of the emergency oxygen system by the conduit and opening through the hollow piston cutter member. This unique arrangement serves as a safety relief for the pressurized container. The safety relief function is provided to address any automatic burst of the rupture disc assembly due to increasing pressure in the cylinder from rising ambient temperatures.

The discharge outlet body is hermetically welded sealed to a metal diaphragm of a thickness appropriate for rupturing while maintaining the design pressure and also to a cylinder neck member that is also welded to be hermetically sealed to the oxygen cylinder. This operation would be hazardous to perform on a charged oxygen cylinder.

An exterior cover member can extend around the discharge outlet body and can mount a driving member, such as an explosive cartridge. The exterior cover member can be sealed to the discharge outlet body and to the cylinder neck member by conventional seals.

A pressure gauge assembly can also be in fluid communication with an interior of the oxygen cylinder and can be hermetically welded to the oxygen cylinder. As one example of a pressure gauge assembly, a helical coil of an open tube configuration can communicate with an interior of the oxygen cylinder through an opening in the pressure gauge housing. The cylinder oxygen pressure can force an indicator, operatively attached at a distal end portion of the helical coil tube relative to a scale, to indicate a pressure measurement of the helical coil tube as an indication of the current interior pressure in the oxygen cylinder. The pressure gauge housing can be hermetically welded to keep the oxygen cylinder sealed and can be positioned, for example, at a bottom surface of the cylinder to enable easy inspection in a storage rack in the aircraft.

The present invention provides a hermetically welded seal for an oxygen cylinder that does not require an internal wetted surface coating. We utilize a stainless steel pressure container with a thin diaphragm stainless steel disk hermetically welded to a housing with the housing subsequently hermetically welded to the cylinder neck of the stainless steel pressure container. By using a stainless steel pressure container such as an advanced Nitronic 21-6-9 steel, we have a highly corrosive resistant container which does not require an internal protective coating. Thus, we have removed the potential hazards of particulate material which could be released and accelerated into a regulator, thereby causing a fire hazard.

In addition, since oxygen is a highly combustible gas, the stainless steel pressure container can employ a method of filling through an auxiliary port in the form of a capillary tubing, for example of a size of about 0.066 inch outside diameter and a size of about 0.010 inch internal diameter. After charging the stainless steel pressure container, for example with 3000 PSI or greater of oxygen pressure, the capillary can be pinched or crimped in several places and in effect collapse the metal tubing to such a degree that it forms a hermetic seal. The open end of the capillary tube, downstream of the pinched hermetically sealed portions, can then be subsequently brazed or spot welded as necessary and any excessive portion of the capillary tube can be gently bent into a circular groove at the base of the cylinder neck member.

Accordingly, the present invention provides an economical solution of a hermetically sealed oxygen cylinder assembly that can realize a 20 year life limit and avoid the requirements of retesting and recharging of three year cycles. The method in which we hermetically seal the oxygen cylinder assembly provides a corrosive resistant joint that is impervious to the use of oxygen and/or other dangerous chemical compounds. Our design permits the hermetic sealing of the oxygen cylinder assembly to be a separate entity from the regulator operating valve and thereby permits the transportation of the oxygen cylinder assembly with a non-thrusting safety cap, thereby lowering shipping costs.

As can be appreciated, the separately charged pressure vessel also permits an easy replacement at the field level for servicing aircraft. Additionally, the sealed oxygen cylinder assembly can be safely removed from the valve allowing a field weight check to ensure container contents have not leaked to unacceptable levels. An alternative embodiment uses a hermetically welded cap supporting the hermetically welded rupturable diaphragm seal on the oxygen cylinder with a threaded discharge housing that supports a piston cutter and an explosive charger that is easily removed from the oxygen cylinder. Thus, the present invention not only permits the utilization of a higher pressure for the oxygen cylinders to provide increased storage capacity, but provides an increased life cycle while reducing the cost of the sealed oxygen cylinder assembly.

Additionally, by using a hermetically sealed ruptured diaphragm, we assure a hermetically welded sealing of the contents of a stainless steel pressure vessel while facilitating its subsequent rupture as required by use through a piston cutter that can be either manually, electrically or pyrotechnically activated. The discharge outlet body that supports the welded diaphragm can also provide, in one embodiment, a safety release conduit for the contents of the oxygen cylinder assembly in case of any accidental over pressurization and/or release of oxygen in an overheated condition.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Oxygen cylinder assemblies have been utilized for storing oxygen in aircraft, initially in military aircraft, and subsequently in civilian passenger aircraft for a significant period of time. The present invention presents an improvement in this relatively crowded field to allow military and commercial aircraft to mount hermetically sealed oxygen cylinders of a particular composition and configuration. The oxygen cylinder assembly has an extended service life and avoids testing and refill requirements with accompanying high labor cost in an industry that has been subject to adverse economic conditions. Thus, the present inventors have recognized a cost effective solution, product and method to address a problem in the aircraft industry.

Figure 1:
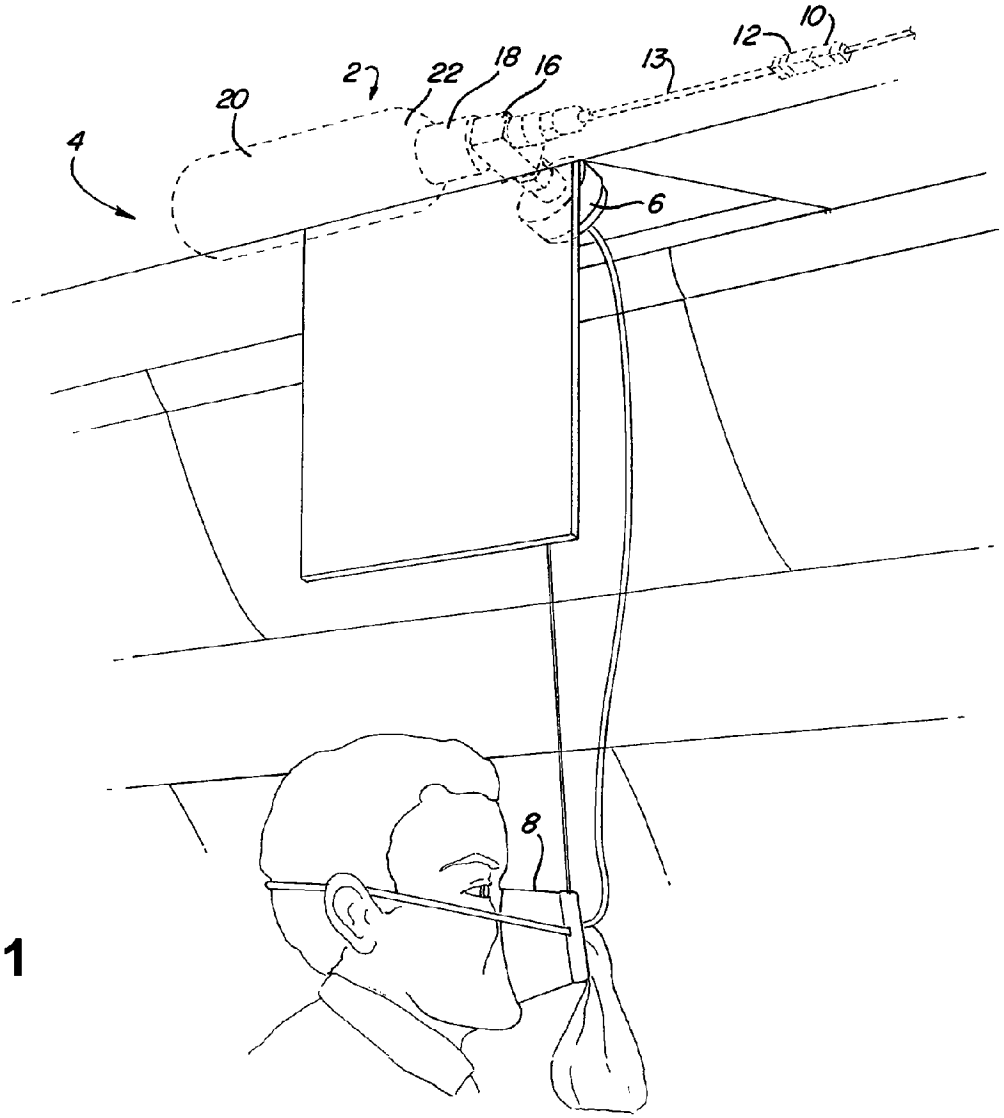
FIG. 1 is a schematic of a small oxygen cylinder assembly for an aircraft passenger.

Referring to FIG. 1, a schematic is disclosed of an oxygen cylinder assembly 2 mounted in an overhead storage compartment 4 in a passenger aircraft. As shown, a mask 8 has dropped from the storage compartment 4 and pressurized oxygen is being regulated by a regulator valve 6. Regulator valve 6 is mounted in a connection port 16. An electrical signal has been transmitted either automatically from a sensor or from the pilot through a connector plug 10 which is attached to a connector receptacle 12 to transmit an electrical current through a connector wire 13 to an explosive cartridge (not shown) in discharge outlet housing 18.

The oxygen cylinder assembly 2 includes a pressurized oxygen cylinder 20 which is integrally connected through a hermetic seal weld 23 to a cylinder neck 22 through a TIG (Tungsten Inert Gas) welding procedure wherein an arc is formed between a non-combustible tungsten electrode and the metal being welded.

Advantageously, the cylinder neck 22 and the pressurized oxygen cylinder 20 can be formed of a stainless steel material such as an advanced Nitronic 21-6-9 stainless steel, which provides a highly corrosive resistant container to pressurized oxygen that importantly does not require any internal protective coatings for the container. The present invention can replace conventional aluminum oxygen cylinders by using a stainless steel material, thereby avoiding the requirement of having any internal protective coating such as the zinc phosphate plating required of the prior art aluminum or carbon steel oxygen cylinders.

Thus, the present invention avoids problems of cracking and chipping of the protective coating so it can be subjected to fairly high temperature changes between an ambient ground temperature and the cruising altitude of the aircraft. The effects of the temperature changes on the coating can cause an expansion and contraction of the cylinder which can precipitate particulate matter into this pressurized oxygen cylinder 20 so that when the contents are discharged, a potential fire danger can occur by a high rate of particle impacts that can accompany the release of the oxygen.

Figure 2:
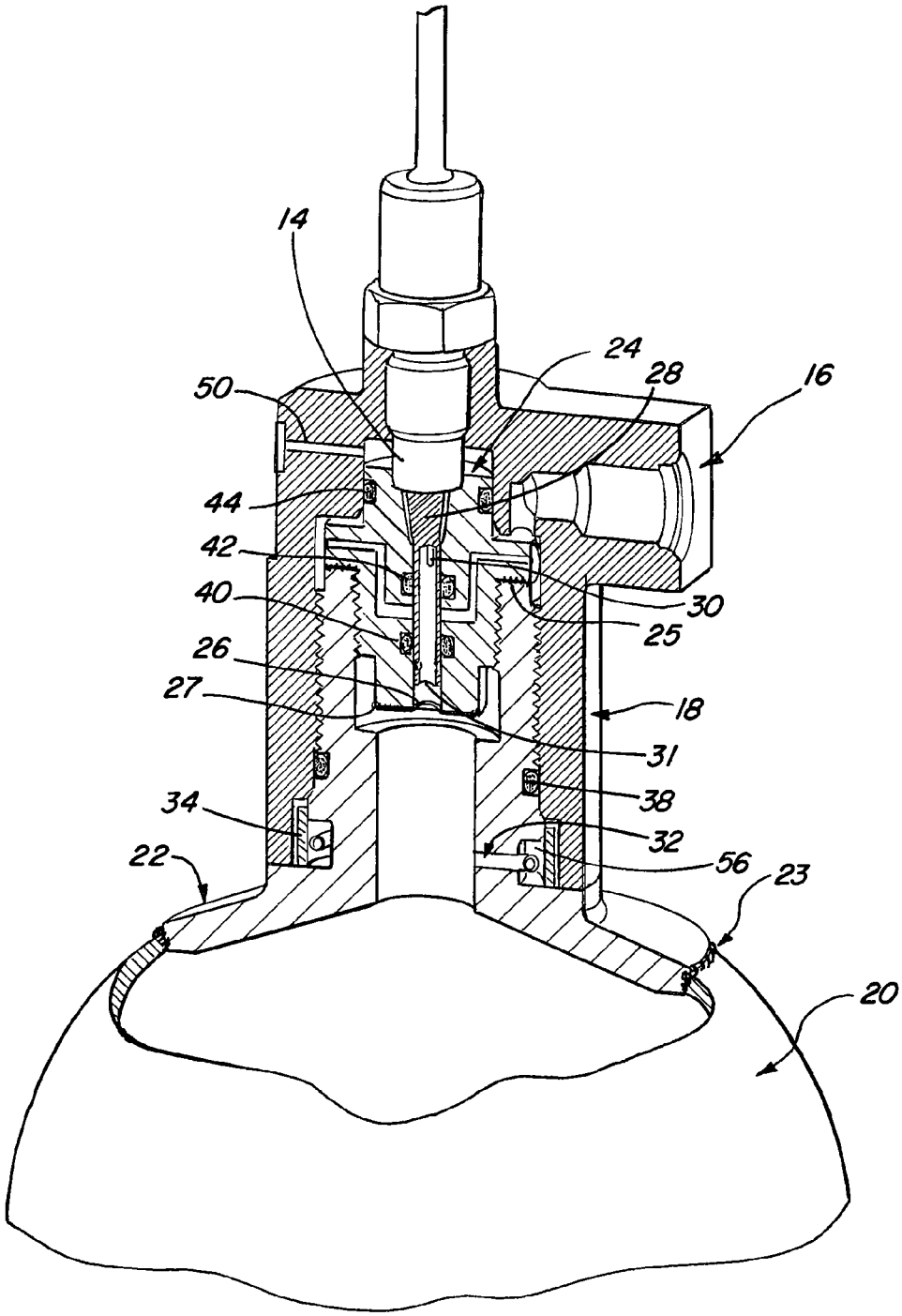
FIG. 2 is a perspective partial view of the oxygen cylinder and the piston cutter assembly.

Referring to FIG. 2, a perspective partial view is shown of an upper region of the oxygen cylinder assembly 2 and specifically the cylinder neck 22. A discharge outlet body 24 can be attached by a TIG weld 25 to hermetically seal that portion of the discharge outlet body 24 to an upper area of the cylinder neck 22. It should be appreciated that the importance of sealing by welding the lower body of the discharge outlet body 24 is to provide a hermetic seal. The discharge outlet body 24 can be formed also of a compatible stainless steel or nickel material. It is also possible to have the discharge outlet body 24 subdivided into a second body that can be removed to permit easier access to the piston cutter member 28, and more particularly, to the O-ring seals 40 and 42, these seals can be coated, for example with a Teflon® coating to extend the life of the O-ring seals, see Creavey Seal Company, www.creavey.com Viton® O-Rings. Providing an upper removable portion of a discharge outlet body 24 downstream of the TIG weld 25 can facilitate access to and replacement of such O-ring seals as necessary, see the embodiment of FIG. 8.

The bottom surface of the discharge outlet body 24 supports a diaphragm metal member 26 of a predetermined thickness, for example approximately in a range of 0.001 inches to 0.008 inches, to enable a rupture of the diaphragm when contacted by the piston cutter member 28 to permit a desired release of the oxygen contents of the oxygen cylinder assembly 2. The metal diaphragm 26 can be of stainless steel or a compatible weldable metal such as Nickel 200/201, Inconel 600, and Inconel 625, that is inert to oxygen. The opening ID of the metal diaphragm 26, as well as the specific thickness varies, depending on the size of the pressure cylinder and the specific pressure range, as can be determined by a person of skill in this field. For example, the capacity and length of pressurized oxygen cylinders for our application can be from approximately 4 inches to 11 inches, but can be smaller or larger.

A TIG weld 27 hermetically mounts the metal diaphragm 26 prior to welding the discharge outlet body 24 to the top opening of the cylinder neck 22 with TIG weld 25. By the provisions of these respective welds 25 and 27, the pressurized oxygen content of the oxygen cylinder 20 can be stored for an extensive time period and can qualify for the classification of DOT 39.

As will be subsequently disclosed, the piston cutter O-rings 40 and 42, along with the discharge outlet body O-ring 44, are to isolate fluid connections for the oxygen contents to respectively, the pressure regulator 6 and alternatively, to a relief passageway 50 in the discharge outlet body 24.

The piston cutter member 28 is to be driven by a driving member such as an explosive cartridge 14 that is designed to provide a moving force while isolating the ignition and resulting gas of the explosive cartridge 14 from any contact with the oxygen contents being released. Alternative driving members such as a solenoid or motor (not shown) can activate the piston cutter member 28.

Figure 3:
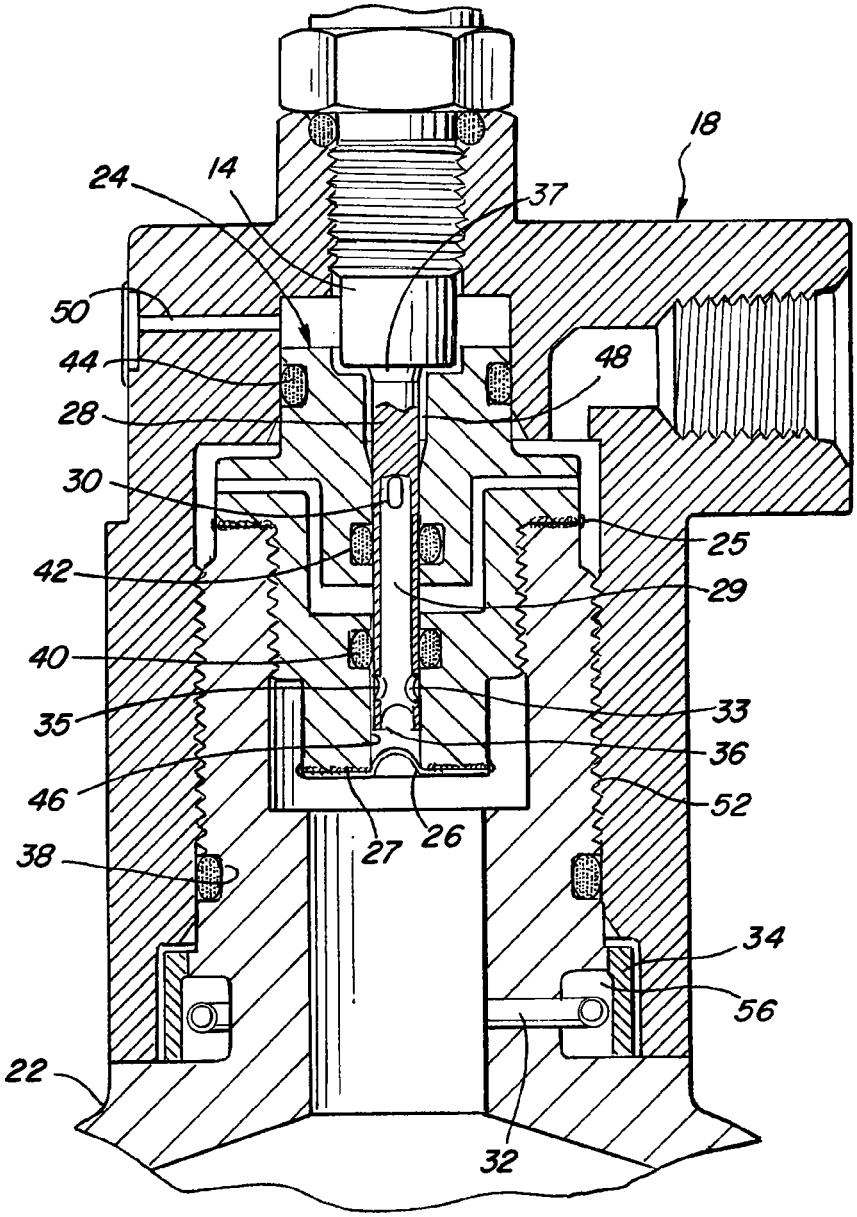
FIG. 3 is a cross-sectional view of FIG. 2 before an explosive cartridge initiation.

The piston cutter member 28 is hollow with a flow passageway 29 from a distal piston cutter edge 31 designed to pierce the rupturable welded diaphragm 26. The distal piston cutter edge can include a pair of sharp pointed prongs. Adjacent the distal piston cutter edge 31 are side wall openings 33 and 35, as can be more readily seen in FIG. 3. These openings 33 and 35 further facilitate the entrance of the pressurized oxygen that is being released to the regulator valve 6 in the mask 8 and are offset to avoid any obstruction from a pierced diaphragm 26, see FIGS. 2 and 3 for pre-ignition position of piston cutter member 28.

A rectangular slot 30 is also provided downstream of the distal end of the piston cutter 28 to enable the release of oxygen into a first passageway communication with the regulator/mask. The piston cutter slot 30 is positioned between the respective O-rings 40 and 42 when the diaphragm 26 is properly pierced.

Figure 5:
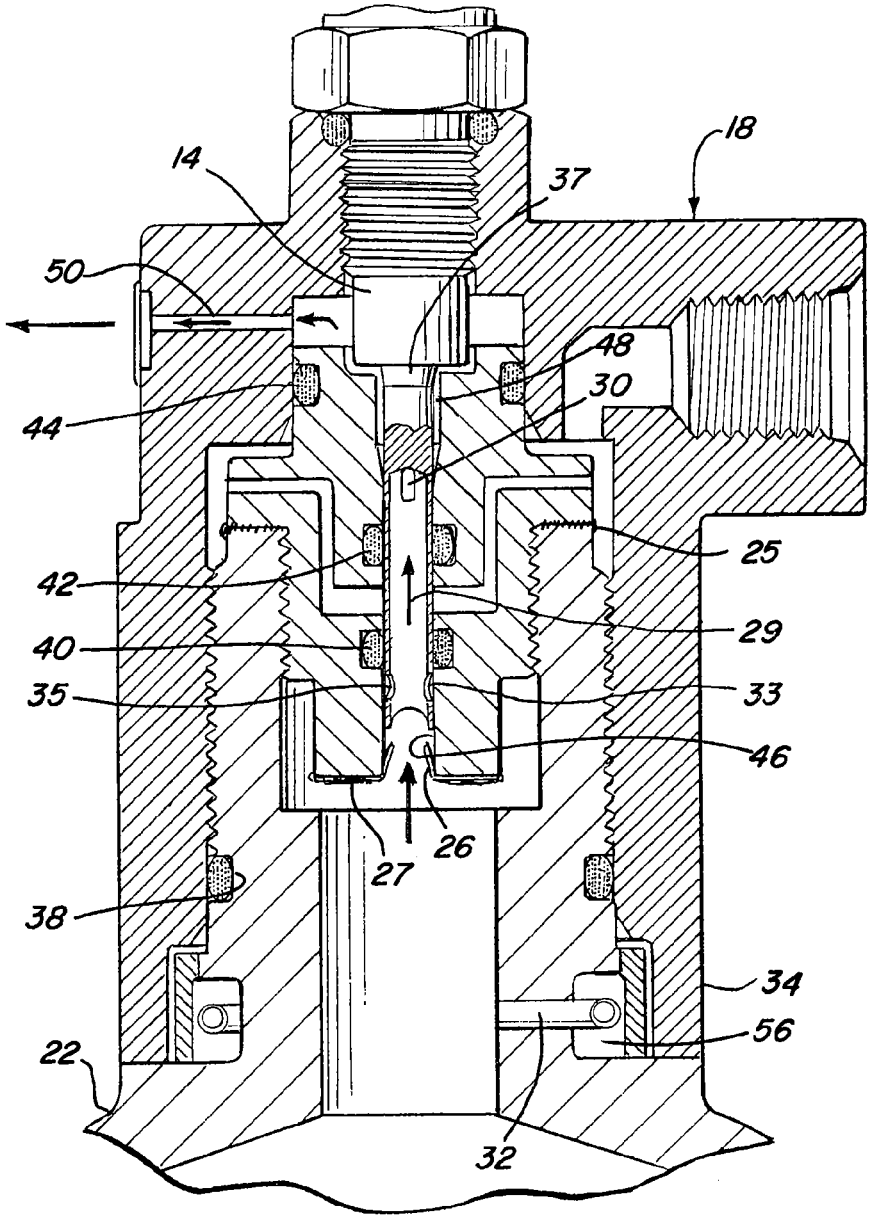
FIG. 5 is a cross-sectional view of FIG. 2 illustrating a conduit for a safety release of oxygen without a cartridge initiation.

A discharge body bore 46 can have an upper portion 48 tapered and enlarged, as shown in FIG. 5, for the purpose of permitting a pressure relief second passageway of any oxygen if the diaphragm seal 26 leaks. This design feature permits any leaking oxygen to flow, also through piston cutter passageway 29 but only with the piston cutter slot 30 communicating with an enlarged upper portion of the discharge body tapered entrance bore 48 which in turn communicates with a relief passageway 50 to dissipate the released oxygen into the cabin as can be shown in FIG. 5.

Figure 4:
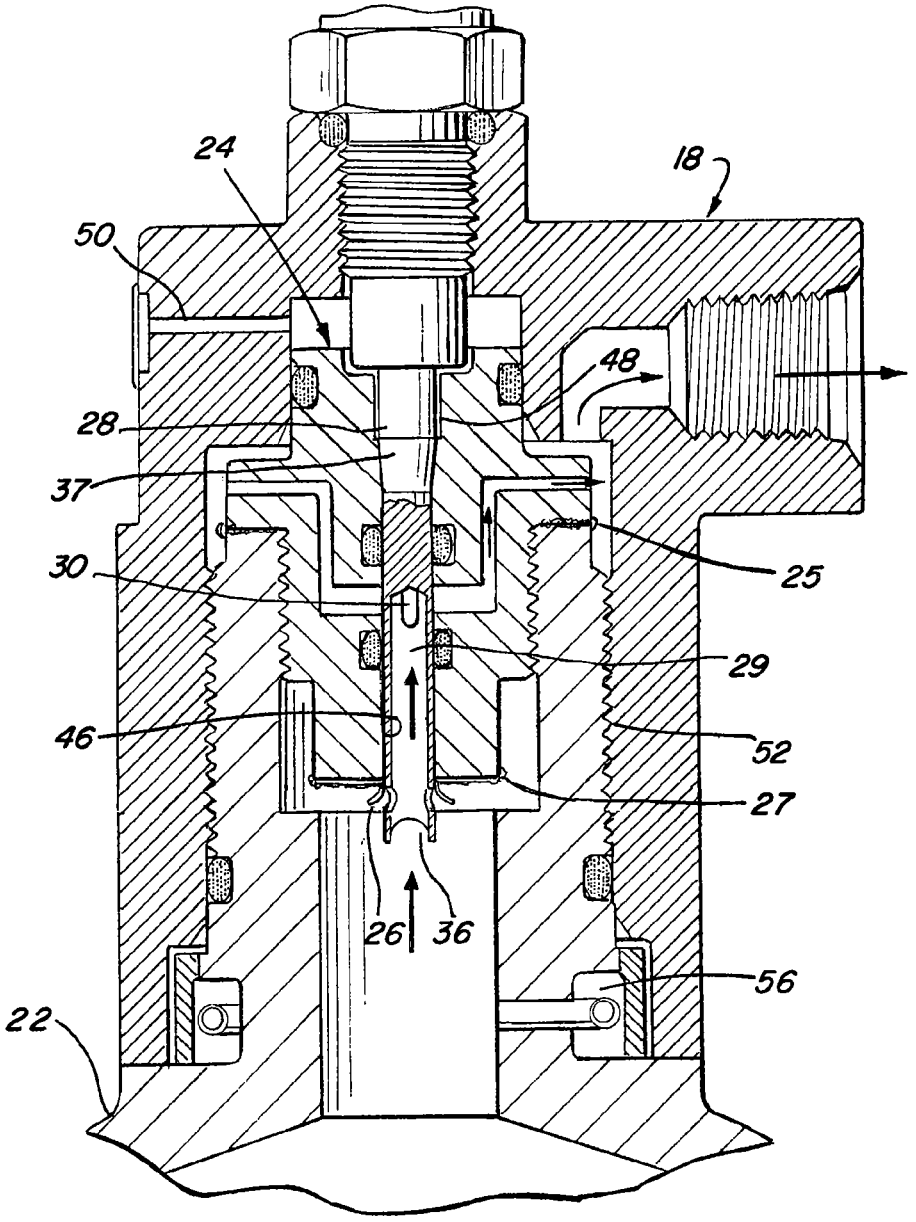
FIG. 4 is a cross-sectional view of FIG. 2 after an explosive cartridge ignition.

When a drive member, such as an explosive cartridge 14, is activated by an electrical charge, the piston cutting member 28 is driven downward to rupture the welded diaphragm 26. Additionally, the upper portion of the piston cutter member 28 wedges itself into the discharge body bore 46 to assist in sealing and fixing the piston cutting member 28 location as the oxygen is being discharged, see FIG. 4.

Figure 6:
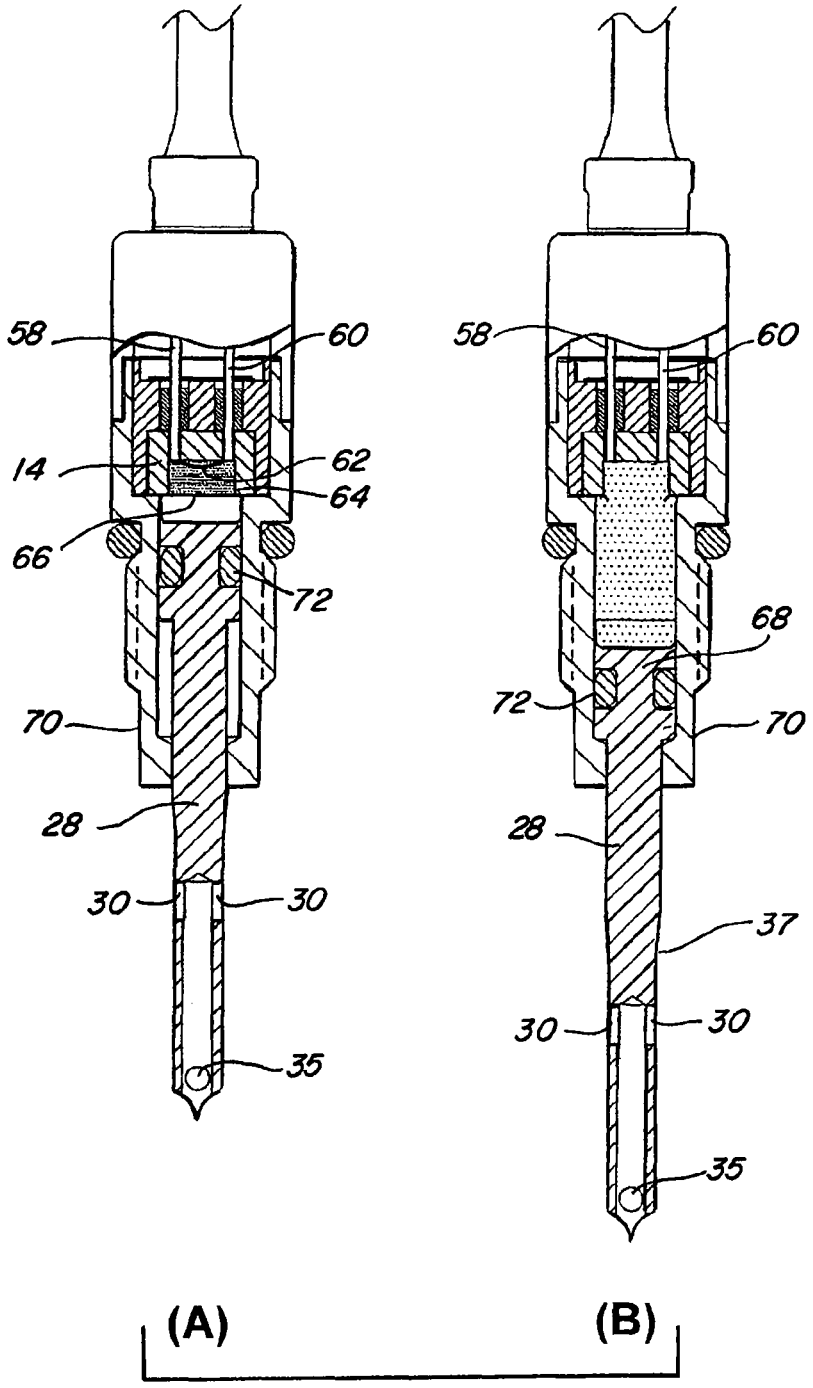
FIG. 6(A) is a schematic view disclosing a pre-ignition and 6(B) is a post ignition view of the explosive cartridge and piston cutter member.

Referring to FIGS. 6(A) and 6(B), an example of an arrangement between the explosive cartridge 14 and the piston cutter member 28, is schematically shown. In FIG. 6(A) an activation signal, in the form of an electric current, is sent across respective pins 58 and 60 that are connected to a bridge wire 62 that extends within a pyrotechnic charge 64. When the electric current heats the bridge wire, it will set off the pyrotechnic charge 64 and produce a sudden expanding of gases as the pyrotechnic charge gases break past a protective diaphragm 66. The piston head 68 that is on top of the piston cutter member 28 receives the pressure force from the expanding gases and is driven downward until it hits a stop lip in the housing 70. An O-ring 72 seals the piston head against the housing 70 and prevents the explosive gases from intermixing with the contents of the pressurized oxygen cylinder 20.

As can be seen in FIG. 6(B), the piston cutter member 28 is driven downward so that the sharp piston cutter distal edges 36 will pierce the welded diaphragm 26 and the tapered conical portion of the piston cutter 37 can be wedged into the bore 46 of the discharge outlet body 24. The pyrotechnic gases that are generated can be contained by additional weld joints. As can be appreciated, the piston cutter member 28, the housing 70 and the explosive cartridge 14 and its fittings can be removed and examined without interfering with the hermetically sealed welding of the diaphragm 26 and the discharge outlet body 24.

The discharge outlet body 24 can be mounted into the threaded opening of the cylinder neck 22. The cylinder neck 22 can also have exterior threads for mounting the threaded portion 52 of the discharge outlet housing 18 that extends downward to a groove for holding a cylinder neck O-ring 38. As can be seen in FIG. 2, the outer edge of the discharge outlet housing 18 defines a first annular flow passageway with the hollow bore of the cutter member 29 to facilitate the release of the oxygen. Preferably the assembly has an O-ring installed in the groove 38. Subsequently, the discharge outlet body 24 is threaded into the interior threads in the mouth of the cylinder neck 22 to be sealed against the top edge of the cylinder neck 22. A TIG weld 25 is then performed to secure and hermetically seal the upper surface of the cylinder neck 22 for the flange of the discharge outlet body 24. Previously, the diaphragm 26 had been TIG welded to provide a hermetic seal to the bottom of the discharge outlet body 24.

Figure 8:
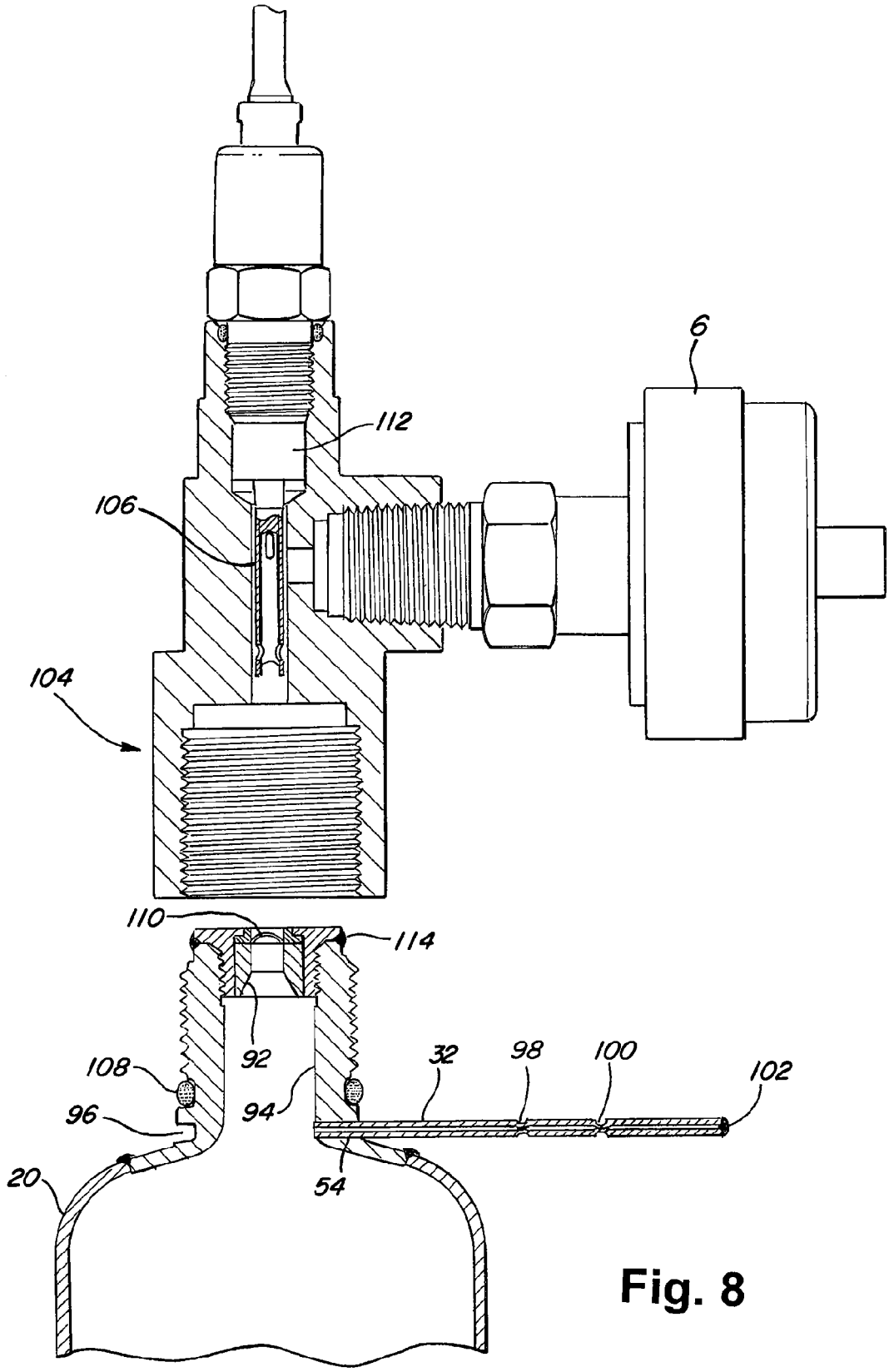
FIG. 8 is a partial cross-sectional view of an alternative embodiment of the present invention with a removable threaded discharge housing.

A capillary tube 32 of a stainless steel metal or other compatible and inert metal such as a nickel alloy, is welded to an internal fill passageway 54 extending through the base of the cylinder neck, see FIG. 8. An annular groove 56 of a rectangular configuration is provided adjacent the base of the cylinder neck 22 and the internal fill passageway 54 can be drilled through the cylinder neck 22 before welding the capillary tube 32 to the entrance of the internal fill passageway 54. The capillary tube 32 has approximately a 0.066 inch outside diameter and an internal diameter of 0.010 inch. The length of the tube is sufficient to provide working space and to enable a multiple crimping of the capillary tube 32 after an oxygen fill. A source of pressure, for example of oxygen of 3000 PSIG or greater, for example 4500 PSIG, permits the charging of the hermetically sealed pressurized oxygen cylinder 20, cylinder neck 22 and lower portion of the discharge outlet body 24 to the desired oxygen pressure.

The capillary tube 32 is then crimped to provide a heitnetic sealing and subsequently can be welded or brazed shut, see FIG. 8. If there is any slight release of oxygen through the crimped portions of the capillary tube 32 it would be insufficient to create a fire hazard and the welding or brazing shut downstream of the crimping portion of the capillary tube 32 provides a permanent seal. The capillary tube 32 can then be bent, without disturbing the crimps or the brazed or welded closure, to be positioned within the annular rectangular groove 56. A protective cylinder sleeve 34 can be mounted to enclose the annular groove 56. See FIG. 3.

Figure 7:
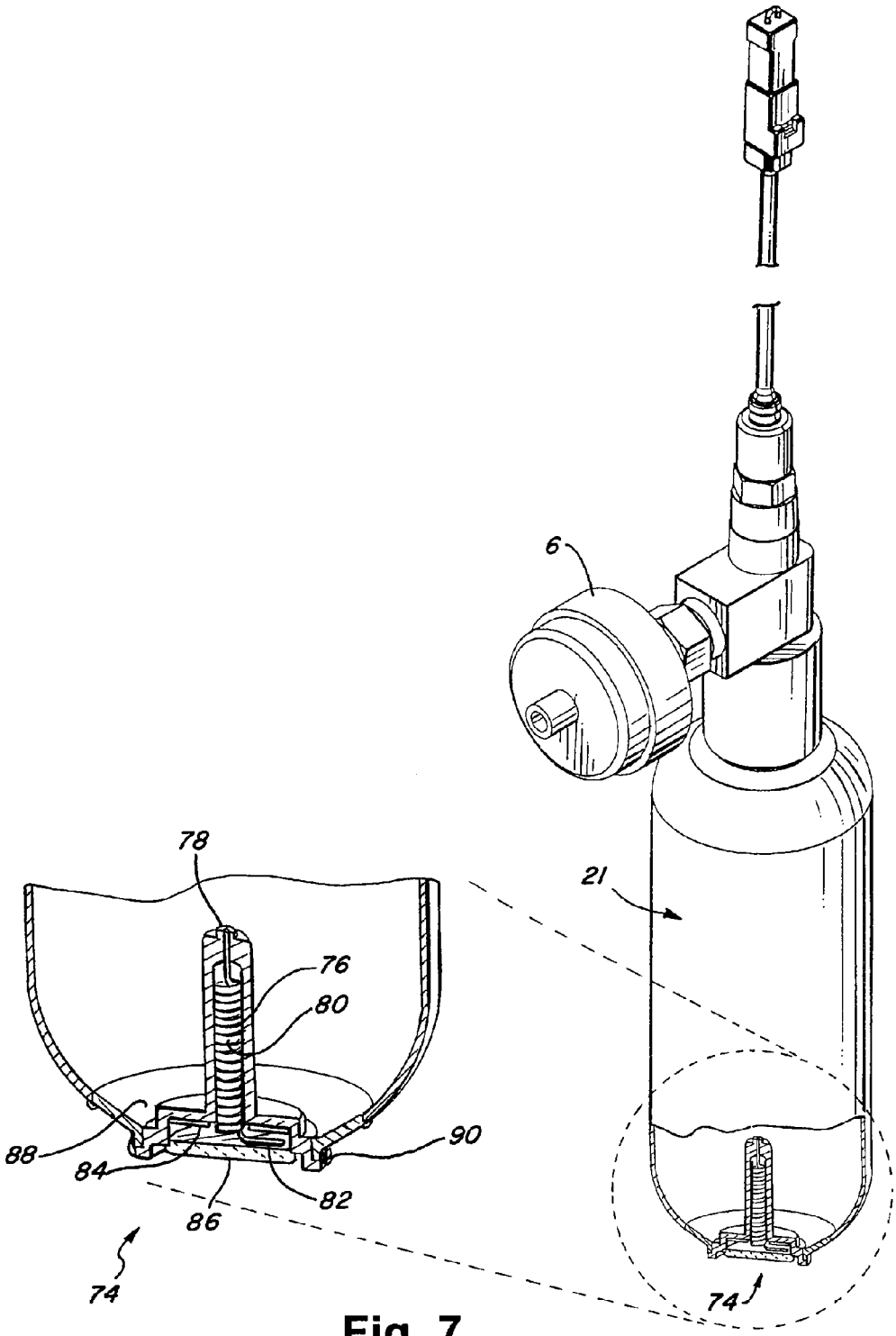
FIG. 7 is a perspective view of the oxygen cylinder assembly with a cutaway cross-sectional view of an integrated hermetically sealed pressure gauge.

Referring to FIG. 7, a pressure gauge assembly 74 can be mounted on a pressure cylinder 21, for example, at a bottom surface with a hermetically sealed TIG weld to thereby provide a visual indicator of the pressure within the pressurized oxygen cylinder 21. A tubular stem housing 76 can have an opening or pressure port 78 which is in communication with a helical coiled tube 80 that is sealed at the bottom and attached to an indicator pointer 82 so that it can rotate across the face of a dial 84 having pressure indication marks to measure any pressure expanding the helical coiled tube 80. A clear crystal plastic cover 86 can be mounted to protect the indicator 82 and permit a visual inspection at the bottom of the pressurized oxygen cylinder 21.

A conical stainless steel disk 88 can mount the tubular stem housing 76 with a TIG weld 90 around the circumference. This conical disk itself is also hermetically sealed with a TIG weld to the bottom of the cylinder body 21.

As can be appreciated, alternatively a capillary tube for pressure filling the oxygen could also be mounted at the bottom of a pressurized oxygen cylinder with an extended length of tube permitting the crimping and welding or brazing shut of the capillary tube.

FIG. 8 provides an alternative embodiment of the present invention where a stainless steel cap 92 initially has a rupturable welded diaphragm 110 TIG welded to hermetically seal the diaphragm 110 to the cap 92. The upper throat of the cylinder neck 94 is threaded to receive complementary threads on the cap 92, to thereby permit a precise mounting and location of the hermetically welded diaphragm 110. After the cap 92 is threaded onto the cylinder neck 94, a TIG weld 114 is provided on the outside to hermetically seal the pressurized oxygen cylinder 20.

As discussed before in the first embodiment, the capillary tube 32 has been welded within a passageway or drilled hole 54 within the cylinder neck 94. An annular groove 56 is provided at the base of the cylinder neck 94. The capillary tube 32 is appropriately crimped and FIG. 8 shows basically two crimps, 98 and 100, but multiple crimping can also occur. These crimps, because of the small size of the capillary tube 32, provide a hermetic seal which can be further confirmed by welding or brazing the open end of the capillary tube 32 with either a weld or braze 102.

A discharge outlet housing 104 has a fluid communication through hollow piston cutter member 106 of a similar configuration to that of the first embodiment piston cutter member 28. The fluid communication is directly connected to a pressure regulator valve 6 for reducing the pressure of oxygen before it is distributed to a passenger or passengers. The discharge outlet housing 104 has an open threaded bore of a dimension to complement the exterior threads on the cylinder neck 94. An O-ring seal 108 can be provided at the base of the cylinder neck 94 to prevent any back flowing of the released oxygen. The discharge outlet housing 104 is removable without affecting the respective hermetically sealed welds on the diaphragm rupturable disk 110 that is TIG welded to the cap 92.

The diaphragm rupturable disks 26 and 110 are pressure tested after welding and create a dome about the central axis of the diaphragm disk. The arrangement and offset distance of the respective piston cutter members 28 and 106 are, accordingly, aligned with these dimensions to ensure a precise position before and after piercing of the diaphragm disk.

With this design, access to and replacement of both the piston cutter member 106 and the explosive cartridge 112 can be easily accomplished. Accordingly, a pressure oxygen cylinder 20 of this configuration can meet the DOT 39 requirements.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. In an emergency oxygen system for aircraft, the improvement comprising:

a hermetically sealed oxygen cylinder of stainless steel with a welded metal diaphragm of a predetermined rupturable characteristic for maintaining the storage of oxygen at a pressure in excess of 1800 PSI;

a hollow capillary tube sealed hermetically at one end to the oxygen cylinder, to provide a passageway for charging oxygen at a pressure in excess of 1800 PSI, into the oxygen cylinder and having a distal length of capillary tube of sufficient size and internal diameter to enable one or more multiple crimps of the capillary tube to provide a hermetic seal while extending outwardly from an exterior of the oxygen cylinder by a distance sufficient to safely have an opposite end of the capillary tube sealed hermetically by an application of heat to close the opposite end with a brazed or welded material, wherein the oxygen cylinder provides an exterior annular groove adjacent the one end of the capillary tube sealed to the oxygen cylinder, of a size to store the capillary tube within the annular grove; and a protective sleeve is mounted on the oxygen cylinder to surround and enclose the annular groove to protect the sealed capillary tube when the oxygen cylinder is storing oxygen.

2. The emergency oxygen system of claim 1 further including a discharge outlet body assembly including a cylinder neck member hermetically welded sealed to the oxygen cylinder with a passageway extending through the cylinder neck member to transport the oxygen, the capillary tube is mounted on the cylinder neck member welded or brazed and is in fluid communication with a conduit through the cylinder neck member to deliver oxygen to the oxygen cylinder.

3. The emergency oxygen system of claim 1 further including a discharge outlet body assembly including a piston cutter member aligned with the metal diaphragm and a driving member for forcing the piston cutter member to rupture the metal diaphragm to release the pressurized oxygen.

4. The emergency oxygen system of claim 3 wherein the piston cutter member is hollow to provide a conduit for directing the released pressurized oxygen.

5. The emergency oxygen system of claim 4 where the piston cutter member has a relief passageway slot opening in a side wall of the hollow portion to provide a safety release of oxygen, apart from the delivery system to enable an inadvertent release of oxygen by the metal diaphragm to the exterior of the emergency oxygen system.

6. The emergency oxygen system of claim 3 wherein the discharge outlet body has a hermetically sealed weld to the metal diaphragm and to a cylinder neck member which is hermetically weld sealed to the oxygen cylinder.

7. The emergency oxygen system of claim 6 further including an exterior cover member extending around the discharge outlet body and mounting the driving member, which includes an explosive cartridge, the exterior cover member is sealed to the discharge outlet body and to the cylinder neck member.

8. The emergency oxygen system of claim 3 wherein the driving member is an explosive cartridge mounted above the discharge outlet body for driving the piston cutter member to rupture the metal diaphragm.

9. The emergency oxygen system of claim 1 wherein the crimped and hermetically sealed capillary tube is bent to extend around a part of a perimeter of the oxygen cylinder within the exterior annular groove.

10. The emergency oxygen system of claim 1 further including a hermetically sealed pressure gauge mounted in a bottom surface of the oxygen cylinder.

11. An emergency oxygen system for aircraft passengers comprising:

a hermetically sealed oxygen cylinder of stainless steel with a hermetically welded metal diaphragm of a predetermined rupturable characteristic for maintaining the storage of oxygen at a pressure in excess of 1800 PSI;

a hollow capillary tube sealed hermetically at one end to the oxygen cylinder, to provide a passageway for charging the oxygen at a pressure in excess of 1800 PSI, into the oxygen cylinder and having a distal length of capillary tube of sufficient length and internal diameter to enable one or more multiple crimps of the capillary tube to provide a hermetic seal when extended outward from an exterior of the oxygen cylinder by a distance sufficient to safely have an opposite end of the capillary tube sealed hermetically by an application of heat to braze or weld to close the opposite end;

a discharge outlet body mounted on the oxygen cylinder to align a cutter member for rupturing the hermetically welded metal diaphragm to release the pressurized oxygen; and a discharge outlet housing having a first passageway for directing the released oxygen to the aircraft passenger, wherein the oxygen cylinder has a cylinder neck with an exterior annular groove, adjacent the one end of the capillary tube sealed to the oxygen cylinder, of a size to store the capillary tube within the annular groove, and a discharge outlet housing surrounds and encloses the exterior annular groove to protect the sealed capillary tube when the oxygen cylinder is storing oxygen.

12. The emergency oxygen system of claim 11 further including a pressure gauge assembly in fluid communication with an interior of the oxygen cylinder and hermetically welded to the oxygen cylinder.

13. The emergency oxygen system of claim 12 wherein the pressure gauge assembly includes a helical coil open tube brazed to a pressure gauge housing and communicating with an interior of the oxygen cylinder through an opening in the pressure gauge housing, an indicator is operatively attached to a distal portion of the helical coil tube to indicate a pressure movement of the helical coil tube as indication of an interior pressure in the oxygen cylinder and a hermetic weld of the pressure gauge housing to the oxygen cylinder keeps the oxygen cylinder sealed.

14. The emergency oxygen system of claim 11 wherein the cutter member is hollow with a piercing open tip to form a portion of the first passageway.

15. The emergency oxygen system of claim 14 wherein a second passageway is in communication with the hollow cutter member portion of the first passageway to provide a release passageway of any leaking oxygen to the exterior of the oxygen cylinder and not directly to the aircraft passenger.

16. The emergency oxygen system of claim 14 further including a drive member to drive the cutter member to pierce the metal diaphragm.

* * * * *